US010039335B2

(12) United States Patent
Cram

(10) Patent No.: US 10,039,335 B2
(45) Date of Patent: Aug. 7, 2018

(54) MULTI-COMPONENT HELMET CONSTRUCTION

(71) Applicant: Bell Sports, Inc., Scotts Valley, CA (US)

(72) Inventor: Daniel Cram, Scotts Valley, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 450 days.

(21) Appl. No.: 13/834,397

(22) Filed: Mar. 15, 2013

(65) Prior Publication Data

US 2014/0143937 A1 May 29, 2014

Related U.S. Application Data

(60) Provisional application No. 61/731,361, filed on Nov. 29, 2012.

(51) Int. Cl.

| | |
|---|---|
| ***A42B 3/04*** | (2006.01) |
| ***A42B 3/06*** | (2006.01) |
| ***A42B 3/32*** | (2006.01) |
| ***A42B 3/20*** | (2006.01) |

(52) U.S. Cl.

CPC ..... *A42B 3/04* (2013.01); *A42B 3/06* (2013.01); *A42B 3/205* (2013.01); *A42B 3/32* (2013.01)

(58) Field of Classification Search

CPC .. A42B 3/04; A42B 3/32; A42B 3/063; A42B 3/0406; A42B 3/10; A42B 3/06; A42B 3/205

USPC ..... 2/410–425, 6.2

See application file for complete search history.

(56) References Cited

U.S. PATENT DOCUMENTS

| | | | | |
|---|---|---|---|---|
| 3,237,203 A | | 3/1966 | Nielsen | |
| 3,239,842 A | * | 3/1966 | Marchello | A42B 3/16 2/10 |
| 3,500,475 A | * | 3/1970 | Otsuka | A42B 3/16 2/421 |

(Continued)

FOREIGN PATENT DOCUMENTS

| | | |
|---|---|---|
| EP | 2263756 A1 | 12/2010 |
| JP | 200080514 | 12/2000 |

(Continued)

OTHER PUBLICATIONS

US Dept. of Transportation, "Test Procedure for FMVSS 118, Power Operated Window, Partition, and Roof Standards", Apr. 2006.*

(Continued)

*Primary Examiner* — Sally Haden
*Assistant Examiner* — Jillian K Pierorazio
(74) *Attorney, Agent, or Firm* — Booth Udall Fuller, PLC

(57) ABSTRACT

A motorsport helmet includes a shell having a lower edge, a liner extending along an interior of the shell, and a support portion coupled to the shell and extending between the shell and the liner adjacent the lower edge. In some configurations, when the helmet is positioned on a DOT Standard No. 218 test head form, a portion of the lower edge is above the test line and a portion of the lower edge is below the test line, and the support portion extends from the portion of the lower edge that is above the test line to a location below the test line. The helmet may also include a muzzle adapted to cover the mouth and chin area of a wearer, and a magnetic coupling assembly releasably coupling the muzzle to the shell.

10 Claims, 12 Drawing Sheets

(56) References Cited

U.S. PATENT DOCUMENTS 3,609,763 A * 10/1971 Raney ..... A42B 3/105 2/415
3,897,596 A * 8/1975 Aileo ..... A42B 3/14 2/420
4,044,399 A * 8/1977 Morton ..... A42B 3/127 2/414
4,101,983 A * 7/1978 Dera ..... A42B 3/0413 2/412
4,209,858 A * 7/1980 Coenen ..... A42B 3/06 2/10
4,665,569 A * 5/1987 Santini ..... A42B 3/32 2/410
4,996,724 A * 3/1991 Dextrase ..... A42B 3/066 2/411
5,212,843 A * 5/1993 Kamata ..... A42B 3/06 2/171.3
5,324,460 A * 6/1994 Briggs ..... A42C 2/007 2/411
5,745,924 A * 5/1998 Egger ..... A42B 3/066 2/171.3
5,898,949 A * 5/1999 Barthold ..... A42B 3/14 2/411
5,915,537 A * 6/1999 Dallas ..... A42B 3/08 2/410
6,094,750 A * 8/2000 Lee ..... A42B 3/10 2/171.3
6,298,497 B1 * 10/2001 Chartrand ..... A42B 3/12 2/414
6,308,343 B1 10/2001 Arai
6,317,896 B1 * 11/2001 Timms ..... A42B 3/08 2/411
6,324,700 B1 * 12/2001 McDougall ..... A42B 3/324 2/414
6,658,671 B1 * 12/2003 Von Holst ..... A42B 3/064 2/412
6,804,829 B2 * 10/2004 Crye ..... A42B 3/08 2/10
6,862,747 B2 * 3/2005 Oleson ..... A42B 3/14 2/416
6,978,477 B2 12/2005 Foote
7,475,434 B2 * 1/2009 Ambuske ..... A42B 3/06 2/425
8,166,573 B1 * 5/2012 Chung ..... A42B 3/32 2/411
9,480,294 B2 * 11/2016 Occhipinti ..... A42B 3/125
2003/0070200 A1 4/2003 Crye et al.
2006/0130219 A1 * 6/2006 Burek ..... A42B 3/08 2/421
2006/0206994 A1 * 9/2006 Rogers ..... A42B 3/08 2/418
2007/0056071 A1 * 3/2007 Smith ..... A42B 3/06 2/5
2007/0136932 A1 * 6/2007 Muskovitz ..... A42B 3/283 2/410
2008/0052808 A1 * 3/2008 Leick ..... A42B 3/003 2/411
2008/0250549 A1 * 10/2008 Summers ..... A42B 3/281 2/425
2009/0126059 A1 * 5/2009 Tack ..... A42B 3/04 2/2.5
2010/0043126 A1 * 2/2010 Morel ..... A42B 3/06 2/411
2010/0180363 A1 * 7/2010 Glogowski ..... A42B 3/122 2/414
2010/0281603 A1 * 11/2010 Ho ..... A42B 3/04 2/411
2011/0072564 A1 3/2011 Krauter
2012/0005810 A1 * 1/2012 Cheng ..... A42B 3/06 2/425
2012/0011631 A1 * 1/2012 Crossman ..... F41H 1/08 2/2.5
2012/0054947 A1 3/2012 Durocher
2012/0060251 A1 * 3/2012 Schimpf ..... A42B 3/064 2/5
2012/0167268 A1 * 7/2012 Crye ..... F41H 1/04 2/6.6
2012/0180199 A1 * 7/2012 Chilson ..... A42B 3/283 2/411
2013/0042396 A1 * 2/2013 Wehtje ..... A42B 3/32 2/411
2014/0020159 A1 * 1/2014 Teetzel ..... A42B 3/0406 2/422
2014/0033406 A1 * 2/2014 Lebel ..... A42B 3/04 2/422

FOREIGN PATENT DOCUMENTS

RU 2350237 C2 3/2009
WO 2012047936 4/2012

OTHER PUBLICATIONS

"between, preposition" dictionary.com. web. Jun. 29, 2016.*
"rivet, n" dictionary.com web. Jun. 29, 2016.*

* cited by examiner

MULTI-COMPONENT HELMET CONSTRUCTION

CROSS REFERENCE TO RELATED APPLICATION

This application claims the benefit of and priority to U.S. Provisional Patent Application No. 61/731,361, filed Nov. 29, 2012, the entire contents of which are hereby incorporated by reference herein.

TECHNICAL FIELD

The invention relates to a protective helmet, and more particularly to a protective helmet having a unique multi-part construction that facilitates lower cost manufacturing of aesthetically appealing helmets that can meet or exceed various helmet safety testing criteria.

BACKGROUND

A physical impact to the head of a person may cause serious injury or death. To reduce the probability of such consequences, protective equipment, such as a helmet, is often used in activities that are associated with an increased level of risk for a head injury. Examples of such activities include, but are not limited to, skiing, snowboarding, sledding, ice skating, bicycling, rollerblading, rock climbing, skateboarding, motorcycling, and other motorsports. In general, a helmet is designed to maintain its structural integrity and stay secured to the head of a wearer during an impact or a series of impacts.

Accordingly, a motorcycle or motorsports helmet is designed to protect the wearer's head, including absorbing and dissipating energy during an impact with a surface, such as the ground. In this regard, motorsports helmet interiors include impact attenuating materials such as an arrangement of padding and/or foam, wherein the impact attenuating materials cover and contact a significant extent of the wearer's head.

Designing a commercially successful motorsports helmet presents unique challenges because consumers of motorsports helmets, such as motorcycle riders, often have very specific tastes regarding the aesthetic appearance of the helmet. Despite the added risk of not wearing a helmet, many motorcycle riders refuse to wear helmets unless compelled to do so by law, and aesthetics is one of the primary reasons cited by motorcyclists for not wearing a helmet. Designing an aesthetically appealing helmet can be challenging because the need for sufficient structural integrity in specific areas of the helmet can limit the ability to produce an aesthetically desirable helmet profile, shape, or contour.

The present invention is provided to solve these limitations and to provide advantages and aspects not provided by conventional motorcycle and motorsports helmets. A full discussion of the features and advantages of the present invention is deferred to the following detailed description, which proceeds with reference to the accompanying drawings.

SUMMARY

In some aspects, a motorsport helmet includes a shell having a lower edge, a liner extending along an interior of the shell, and a support portion coupled to the shell and extending between the shell and the liner adjacent the lower edge. The support portion may include a rear extension extending downwardly from the lower edge, and the liner may include a liner rear extension that extends downwardly from the lower edge along an interior of the support portion. The lower edge may define a closed perimeter of the shell and may reside substantially in a single plane. The liner may include a forward portion having a bottom surface, and the bottom surface may be substantially co-planar with the lower edge of the shell. The support portion may comprise a ring structure. The support portion may include a central band having a substantially triangular cross section and extending around a circumference of the support portion. The support portion may include an attachment lip extending upwardly from the lower edge and into the shell between the shell and the liner, and the attachment lip may couple the support portion to the shell. The helmet may also include a lower extension overlying the support portion below the lower edge. The helmet may also include a muzzle adapted to cover the mouth and chin area of a wearer, and a magnetic coupling assembly releasably coupling the muzzle to the support portion.

In other aspects, a motorsport helmet includes a shell having a first part adapted to cover a first portion of a wearer's head, and a second part adapted to cover a second portion of the wearer's head. The first and second parts are separately formed and joined together. The first and second parts may be joined together by fasteners. The first and second parts may be formed of different materials. The first and second parts may have different thicknesses. The motorsport helmet may also include a chinstrap having a forward strap member and a rearward strap member. The forward strap member may be coupled to the first part of the shell and the rearward strap member may be coupled to the second part of the shell.

In other aspects, a motorsport helmet includes a shell, a muzzle adapted to cover the mouth and chin area of a wearer, and a magnetic coupling assembly releasably coupling the muzzle to the shell. The motorsport helmet may also include a liner extending along an interior of the shell, and a support portion may be coupled to the shell and may extend between the shell and the liner adjacent a lower edge of the shell. The magnetic coupling assembly may be secured to the support portion at a location below the lower edge of the shell. The motorsports helmet may also include a ratchet assembly extending between the magnetic coupling assembly and the shell.

In other aspects, a motorsport helmet includes a shell having a lower edge, and a support portion coupled to the shell along the lower edge. When the helmet is positioned on a test head form having a test line as specified by Unites States Department of Transportation Standard No. 218, a portion of the lower edge is above the test line and a portion of the lower edge is below the test line, and the support portion extends from the portion of the lower edge that is above the test line to a location below the test line. The motorsport helmet may also include an impact attenuating liner extending along an interior of the shell. The impact attenuating liner may include a forward portion having a bottom surface that is substantially co-planar with the lower edge, and a rear extension extending below the lower edge along an interior of the support portion.

BRIEF DESCRIPTION OF THE DRAWINGS

To understand the present invention, it will now be described by way of example, with reference to the accompanying drawings.

DETAILED DESCRIPTION

Figure 1:
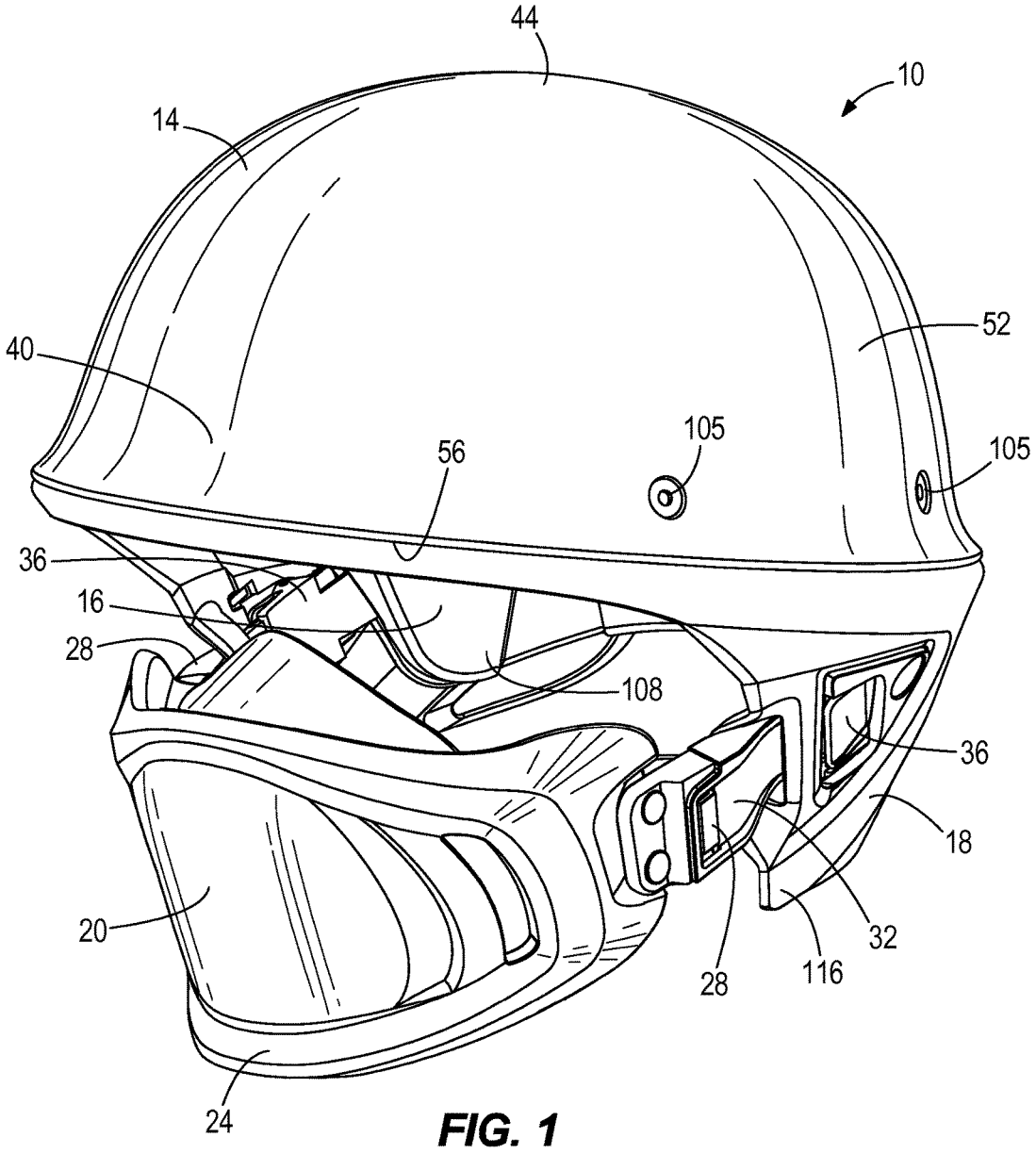
FIG. 1 is a perspective view of an inventive motorsport helmet according to one embodiment.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

In the Figures, and referring initially to FIGS. 1-4, an embodiment of a helmet 10 in accordance with the present invention is shown and includes an impact-resistant outer shell 14, an impact-attenuating liner 16 extending along an interior of the shell 14, a lower extension 18 coupled to and extending downwardly from the shell 14, and a faceguard assembly 20 releasably coupled to the lower extension 18. In some embodiments the outer shell 14 comprises a fiber-reinforced material, such as fiber-reinforced plastic, carbon fiber, aramid, fiberglass, or the like. In other embodiments, the outer shell 14 may also or alternatively comprise polycarbonate, ABS plastic, various metal alloys, and the like. The lower extension 18 may similarly comprise polycarbonate, ABS plastic, a nylon reinforced plastic, and the like. The faceguard assembly 20 includes a guard portion 24, two magnetic coupling assemblies 28 coupling the guard portion 24 to two strap assemblies 32, and two ratchet assemblies 36 coupled to the lower extension 18 and releasably coupling respective ones of the strap assemblies 32 to the lower extension 18. The faceguard assembly 20 is discussed below in further detail.

The helmet 10 includes a frontal portion 40 that overlies the wearer's forehead, a top or crown portion 44 that overlies the crown region of the wearer's head, a rear portion 48 that overlies at least the wearer's occipital region, and side portions 52 extending along the sides and temple regions of the wearer's head. In the illustrated configuration, the shell 14 includes a peripheral lower edge 56 that defines an interface or parting line 57 between the shell 14 and the lower extension 18. The lower edge 56 is continuous and defines a closed perimeter of the shell 14. In the illustrated embodiment, the lower portion 15 of the shell 14 adjacent the lower edge 56 flares generally outwardly to define a recess 15*a*, and the lower edge 56 and the parting line 57 each reside substantially in a single plane. The resulting aesthetic appearance is reminiscent of a military helmet, which is often deemed aesthetically appealing by certain members of the motorsports enthusiast community. The multi-part construction of the helmet 10, discussed subsequently, expands the aesthetic design options available to the designer by allowing for the use of different manufacturing techniques and for the use of different materials and/or material thicknesses in areas of the helmet that provide different levels of protection.

Figure 5:
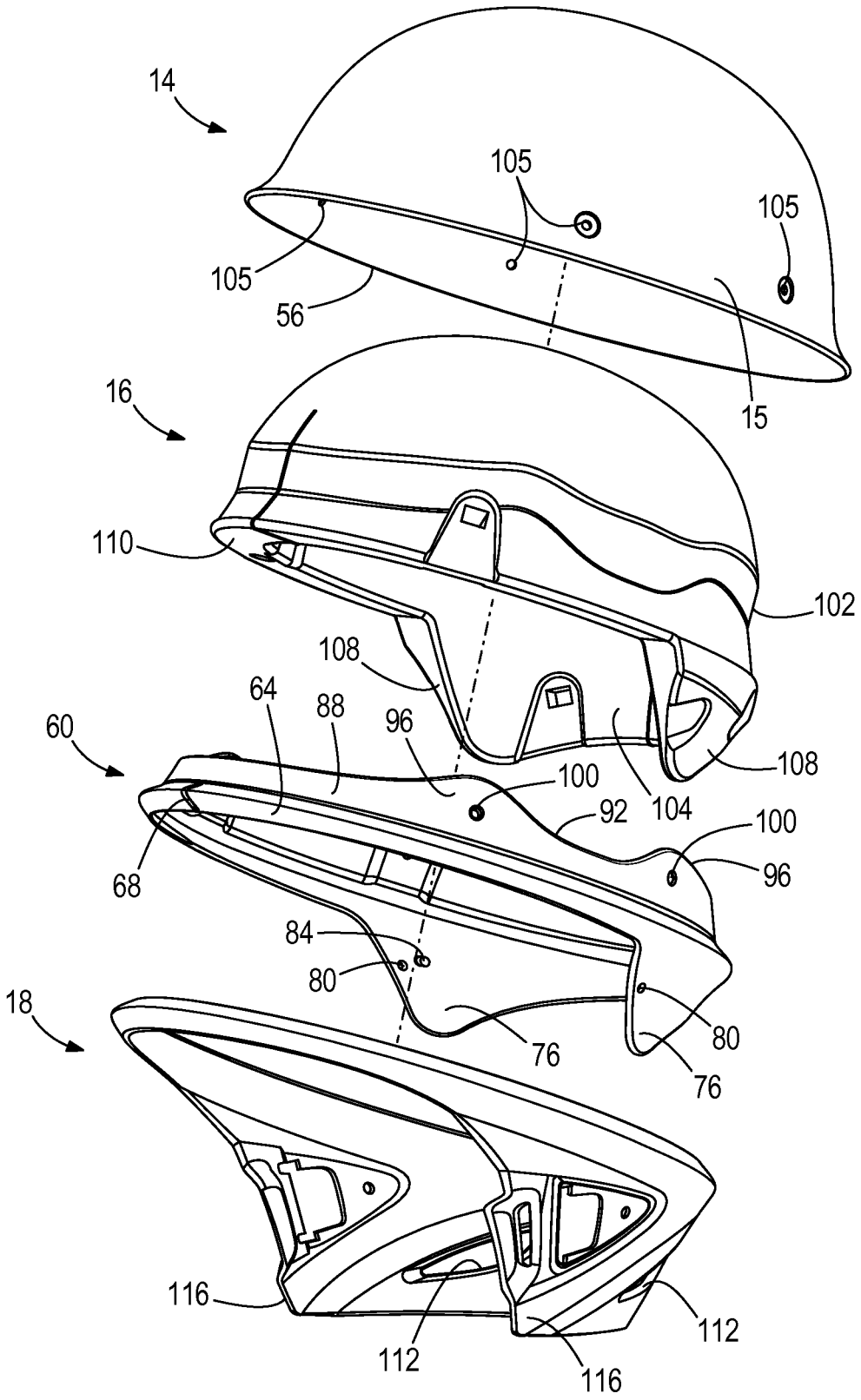
FIG. 5 is an exploded perspective view of the helmet of FIG. 1 with a faceguard removed.
Figure 6:
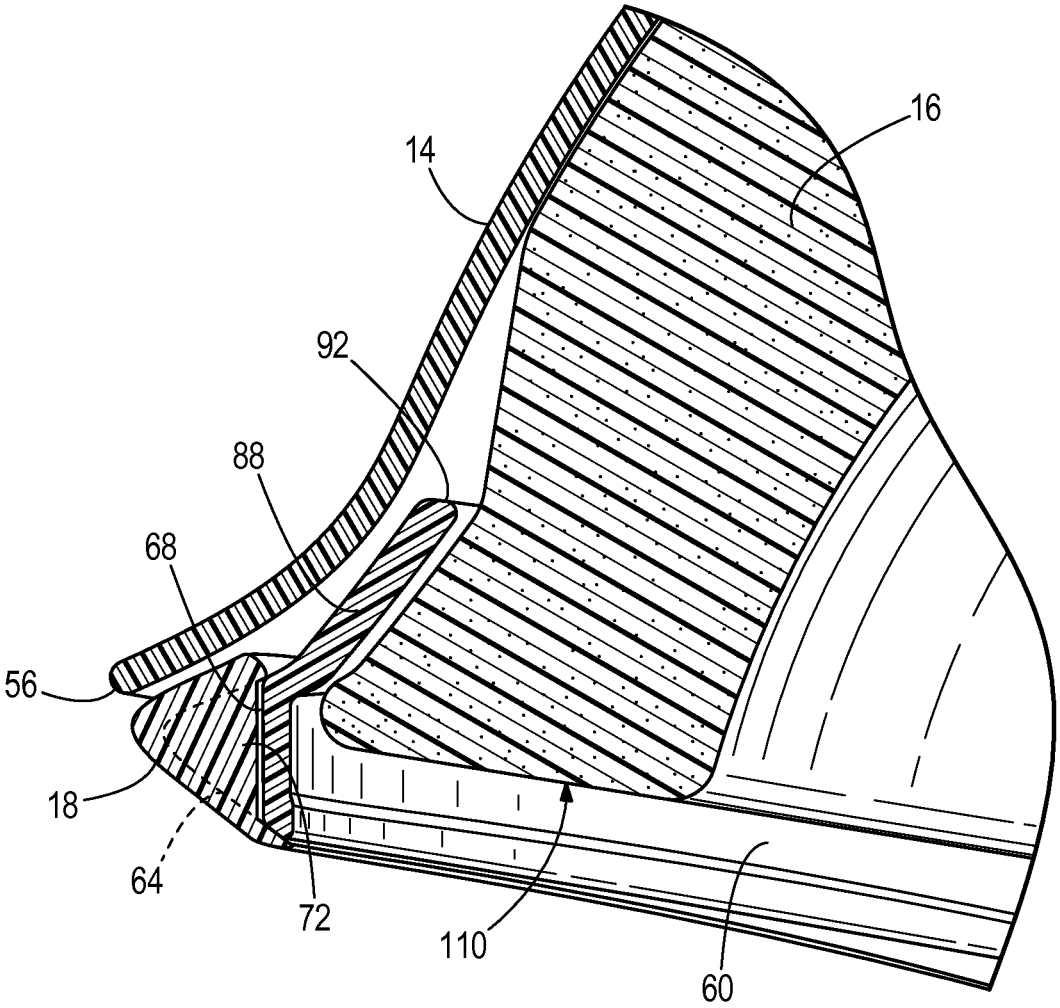
FIG. 6 is a partial section view taken along line 6-6 of FIG. 3.
Figure 7:
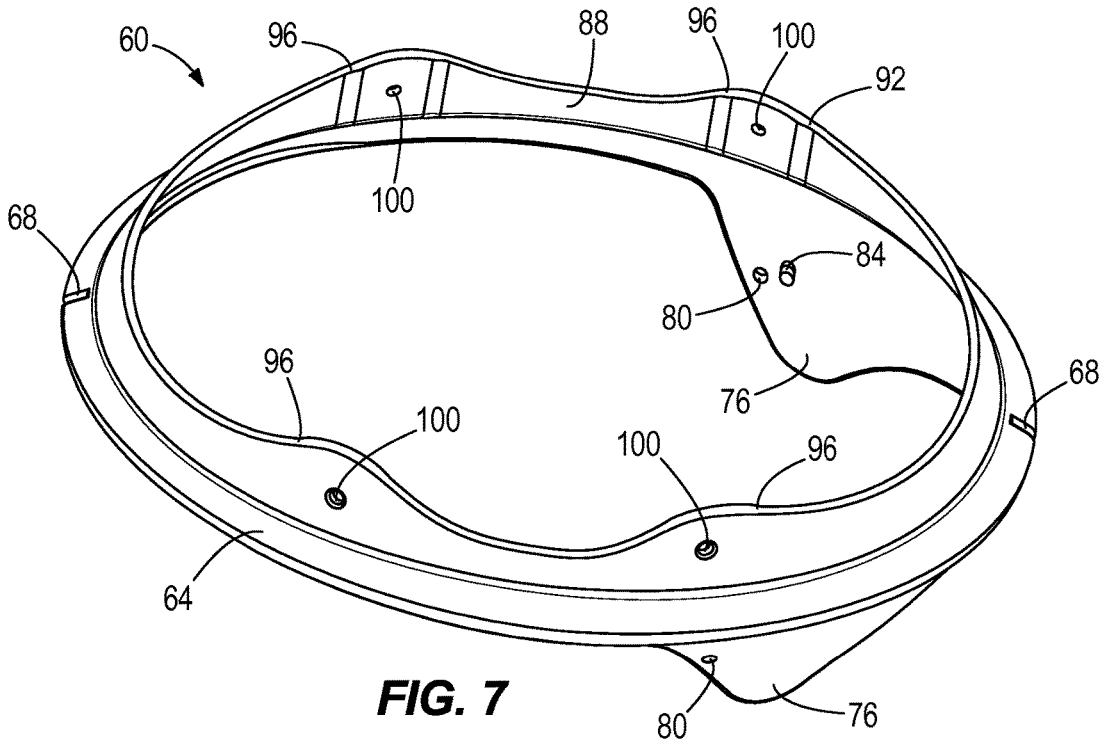
FIG. 7 is a perspective view of an inner support portion of the helmet of FIG. 1.

Referring also to FIGS. 5-7, the helmet 10 also includes an inner support portion 60 that, in the illustrated embodiment, is in the form of an inner ring positioned between the shell 14 and the liner 16. The illustrated inner support portion 60 is a single, continuous piece; however, other embodiments may include a multi-piece or discontinuous inner support portion 60. The inner support portion 60 includes a central band 64 having a substantially triangular cross section and extending around the circumference of the support portion 60. The central band 64 defines diametrically opposed forward and rearward slots 68 that receive corresponding ribs 72 (see FIG. 6) provided on the lower extension 18 to at least partially align the inner support portion 60 with the lower extension 18 during assembly. The inner support portion 60 may be formed of, for example, injection-molded Nylon, ABS, or a similarly stiff, strong, and impact resistant material.

The support portion 60 also includes a pair of rear extensions 76 that extend downwardly from the central band 64 in an area located generally behind the ear of a wearer when the helmet 10 is worn. Each rear extension 76 includes a through hole 80 and an inwardly extending pin 84 to which the lower extension 18 and the ratchet assembly 36 may be coupled. An attachment lip 88 extends generally upwardly and, in the illustrated construction, also inwardly from the central band 64. The attachment lip 88 is sized and configured to fit closely within the flared lower portion 15 of the shell 14 adjacent the lower edge 56 (FIG. 6). In this regard, the attachment lip 88 extends between a lower end of the liner 16 and the flared lower portion 15 of the shell 14 adjacent the lower edge 56. In the illustrated configuration, the attachment lip 88 includes an undulating or generally serpentine upper edge portion 92. The undulating upper edge portion 92 defines four circumferentially spaced apart attachment lobes 96 that extend upwardly to a greater extent than other portions of the attachment lip 88. Each attachment lobe 96 includes an attachment location, such as the illustrated through holes 100, for attachment of the shell 14 to the inner support portion 60. The shell 14 includes a set of corresponding through holes 105 that align with the through holes 100 when the shell 14 is positioned over the attachment lip 88. In the illustrated embodiment, the shell 14 and the inner support portion 60 are configured to be coupled together by fasteners, such as rivets. In other embodiments, different types and combinations of mechanical fasteners, locking tabs, and/or adhesives or other bonding methods may also or alternatively be used.

Figure 8:
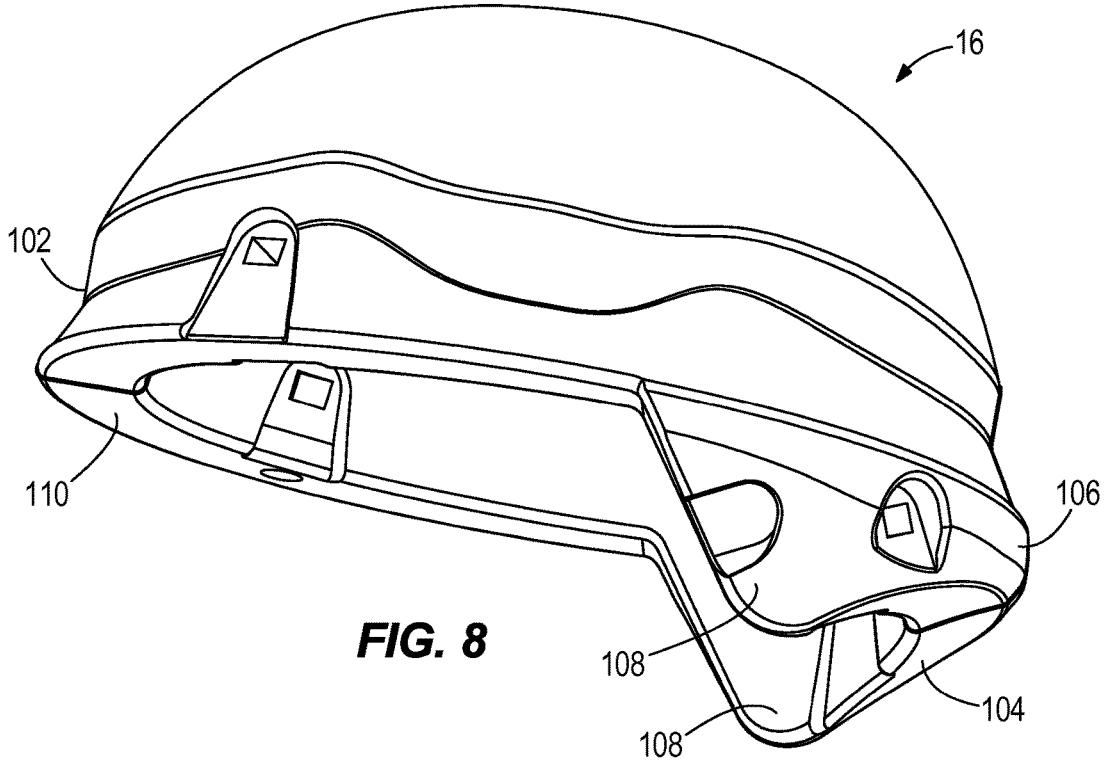
FIG. 8 is a perspective view of an energy-attenuating liner of the helmet of FIG. 1.

Referring also to FIGS. 5 and 8, the liner 16 may be formed as one piece, as shown, or may comprise several pieces, and may be bonded or otherwise joined to at least one of the shell 14 and the support portion 60. The liner 16 may include EPS, EPP, vinyl nitrile, or substantially any other suitable impact attenuating material. The liner 16 includes a circumferentially extending recess 102 that receives the attachment lip 88 of the support portion 60. A rear extension 104 of the liner 16 extends generally downwardly from the recess 102 and opposes and extends along an interior of the rear extensions 76 of the support portion 60. The liner rear extension 104 includes a rear portion 106 and a pair of opposed side portions 108. The liner rear extension 104 gradually tapers from a maximum thickness at the rear portion 106 to a reduced thickness at the distal ends of the side portions 108. The side portions 108 also gradually taper from a maximum thickness area adjacent the recess 102 to the reduced thickness area at the distal end of each side portion 108. As seen in FIG. 6, a bottom surface 110 of a forward portion of the liner 16 is substantially even, e.g., co-planar, with the lower edge 56 of the shell 14. The rear extension 104, which extends below the lower edge 56 of the shell 14, thus provides additional energy-attenuating material below the lower edge 56 of the shell 14.

The lower extension 18 covers both the inner support portion 60 and portions of the liner 16. The lower extension 18 acts as a shroud and includes rear vents 112 that help cool the back of a wearer's neck. The lower extension 18 also includes ear flaps 116 that extend downwardly from the central band 64 and forwardly from the rear extension 76 of the support portion 60 to cover the wearer's ears. The ear flaps 116 also provide guide and attachment locations for the strap assemblies 32 and ratchet assemblies 36 of the faceguard assembly 20.

Figure 9:
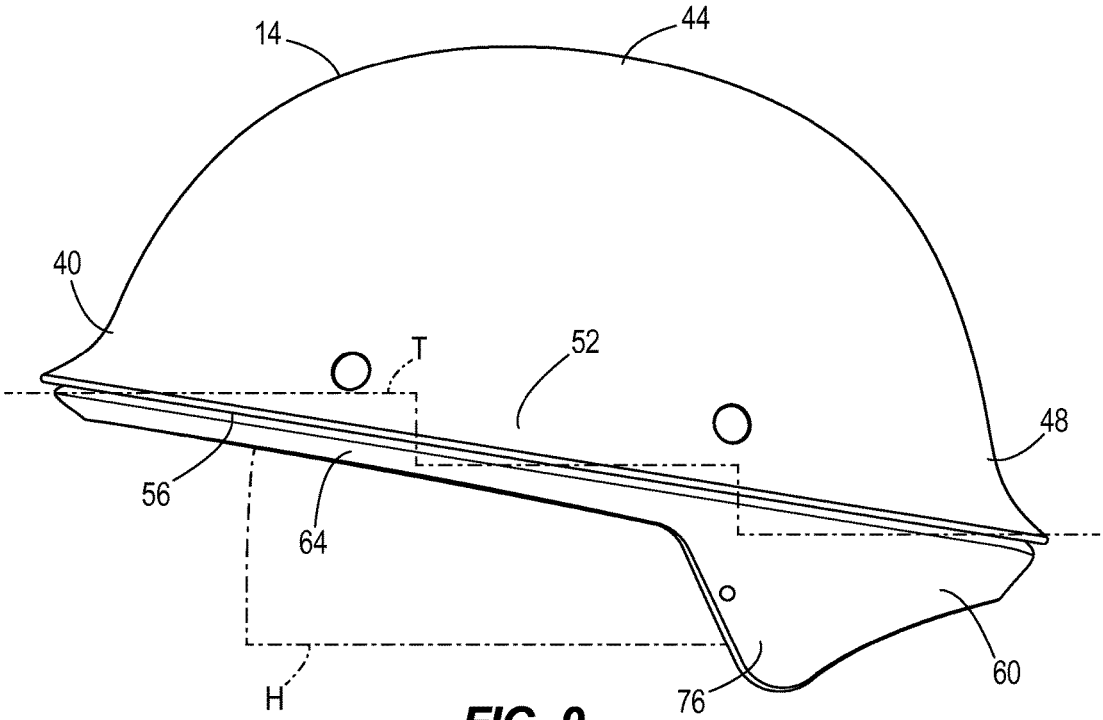
FIG. 9 is a side elevation view of portions of the helmet of FIG. 1 positioned on a test head form.

Referring also to FIG. 9, the shell 14 and the support portion 60 are shown positioned on a test head form H as defined by United States Department of Transportation (DOT) Standard No. 218 ("the Standard"), which establishes performance requirements for helmets designed for use by motorcyclists and other motor vehicle users, and which is hereby incorporated by reference in its entirety. The head form H is anatomically similar to the head of a helmet wearer. FIG. 9 also shows test line T, which corresponds to the "test line" defined in the Standard, above which the helmet 10 must provide certain levels of protection in order to comply with the Standard. The test line T is staggered or stepped and defines a series of test planes that extend perpendicularly into and out of the page with respect to FIG. 9.

As shown in FIG. 9, with the helmet 10 positioned on the head form H, the lower edge 56 of the shell 14 crosses the test line T such that a portion of the lower edge 56 is positioned below the test line T and a portion of the lower edge 56 is positioned above the test line T. In the illustrated embodiment, the lower edge 56 crosses the test line T in several locations such that some portions of the lower edge 56 are below the test line T and some portions of the lower edge 56 are above the test line T. As a result, the shell 14 only partially covers the test area of the head form H, which is defined as the area of the head form H located above the test line T. The portions of the test area not covered by the shell 14 are instead covered by the support portion 60. More specifically, a portion of the test area below the front 40 of the shell 14 and a portion of the test area below the sides 52 of the shell 14 are covered by the central band 64 of the support portion 60, and a portion of the test area below the rear 48 of the shell 14 is covered by the central band 64 and the rear extensions 76 of the support portion 60. The portion of the test area below the rear 48 of the shell 14 is also covered by the rear extension 104 of the liner 16.

Figure 2:
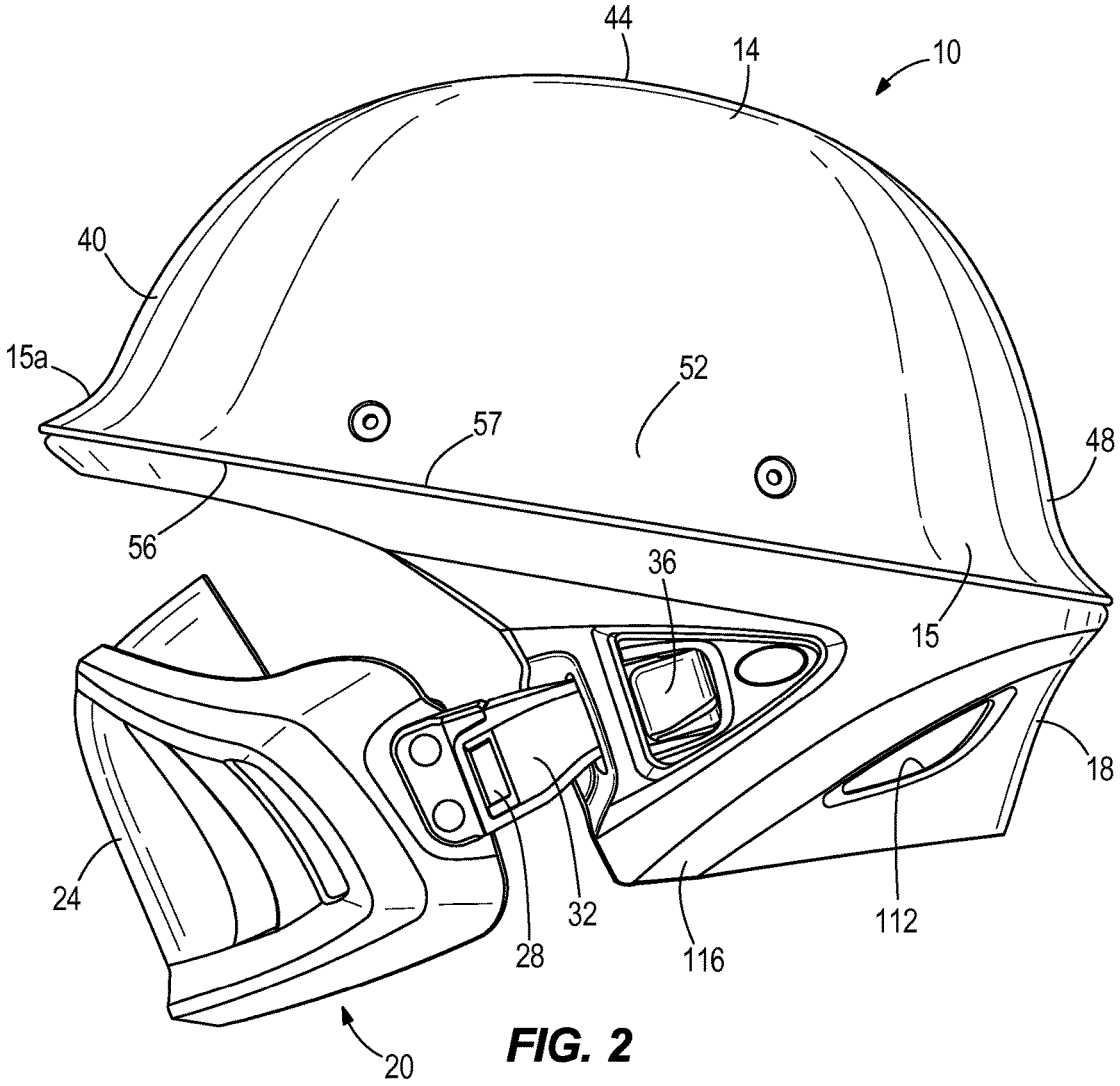
FIG. 2 is a left side view of the helmet of FIG. 1.
Figure 3:
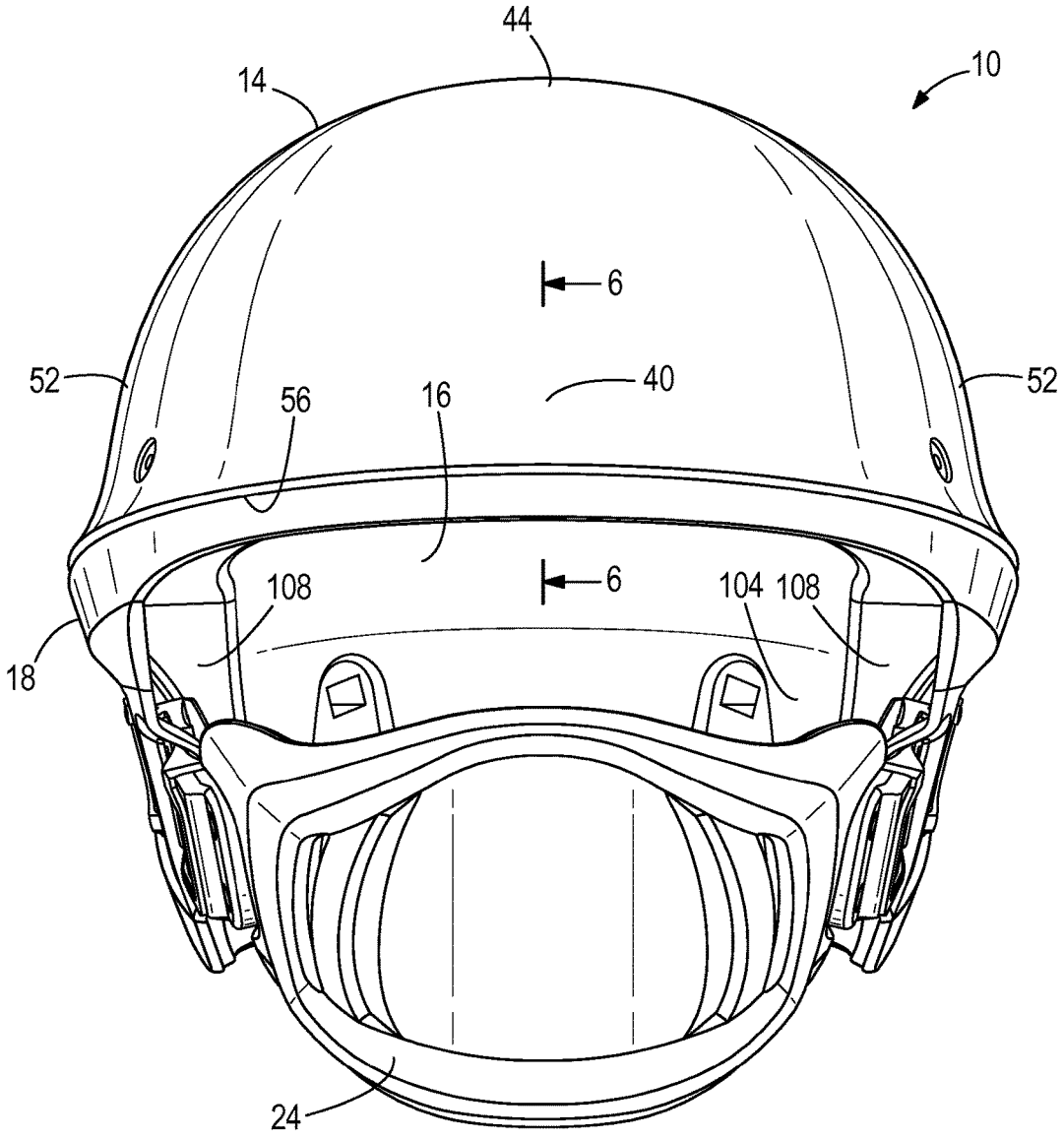
FIG. 3 is a front view of the helmet of FIG. 1.
Figure 4:
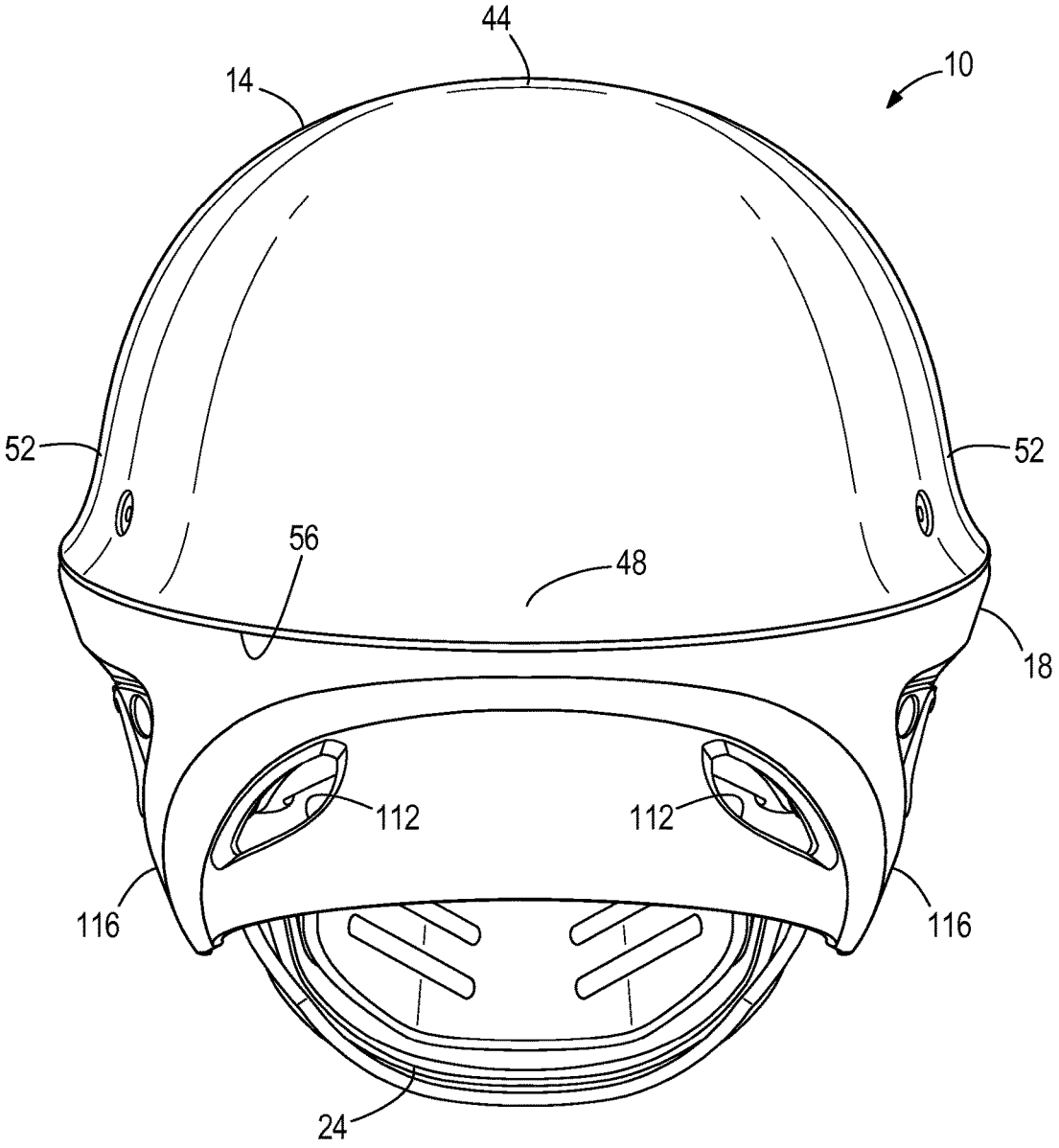
FIG. 4 is a rear view of the helmet of FIG. 1.
Figure 10:
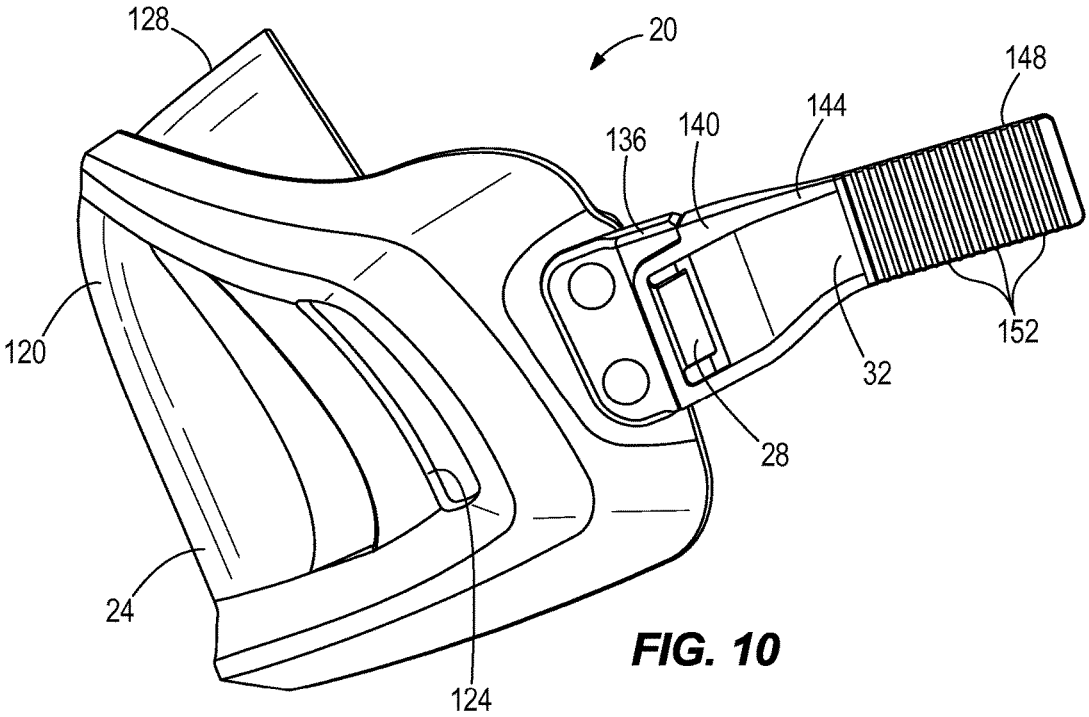
FIG. 10 is a left side view of a faceguard of the helmet of FIG. 1.
Figure 11:
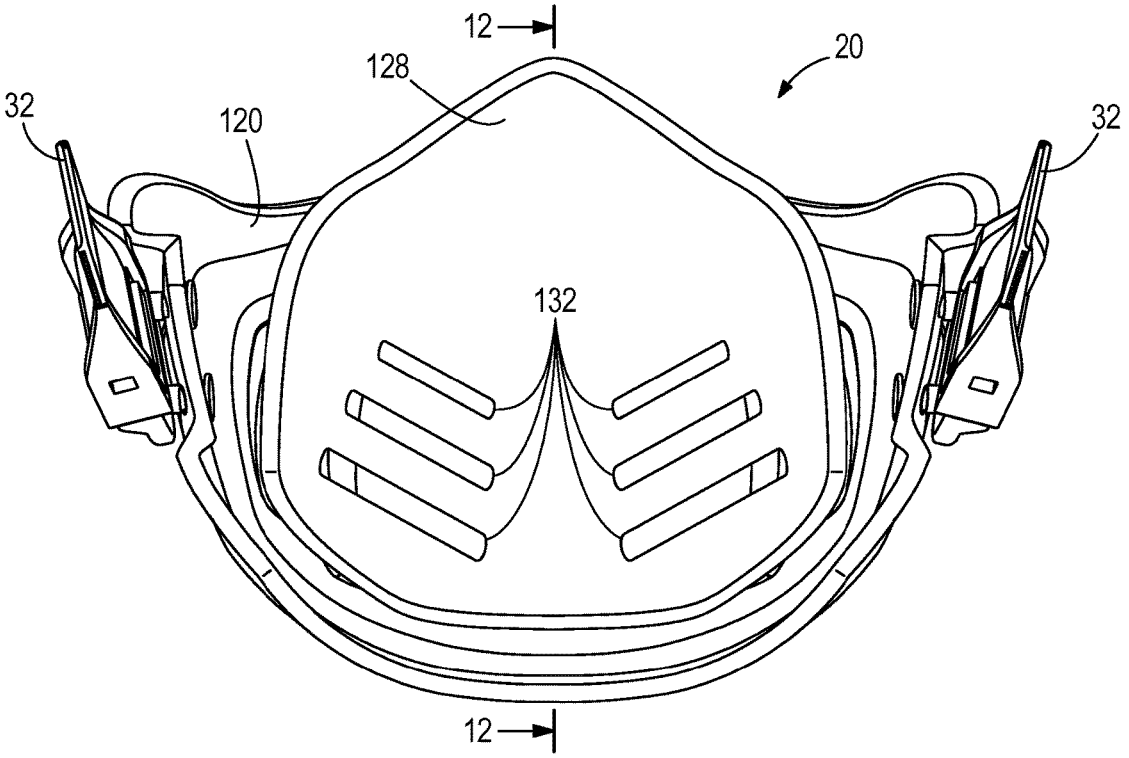
FIG. 11 is a rear elevation view of the faceguard of FIG. 10.
Figure 12:
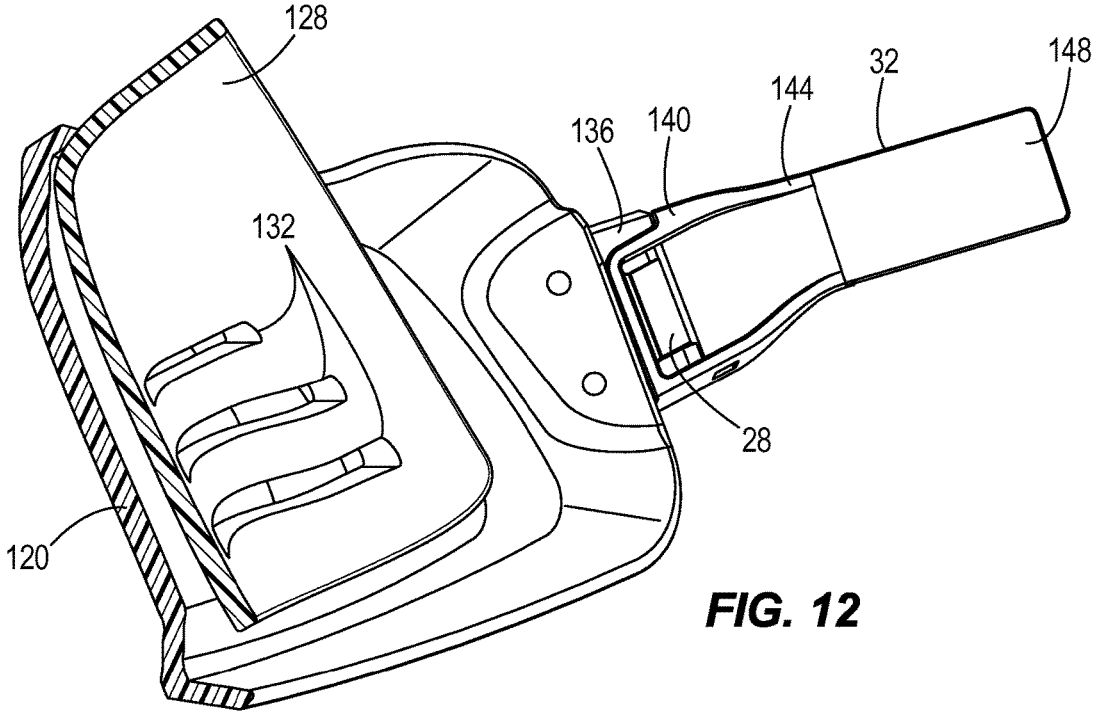
FIG. 12 is a section view taken along line 12-12 of FIG. 11.

Referring also to FIGS. 10-12, the faceguard assembly 20 includes the previously-mentioned guard portion 24, magnetic coupling assemblies 28, strap assemblies 32, and ratchet assemblies 36 (see FIGS. 1-2). The guard portion 24 includes a protective muzzle 120 including side ventilation openings 124, and a resilient breath box 128 coupled to the muzzle 120. The breath box 128 is formed of a resilient material, such as thermoplastic elastomer, and is configured for direct engagement with the wearer's nose, mouth, and chin area. The breath box 128 includes a plurality of vent openings 132 in a location that is proximate the wearer's mouth when the breath box 128 is positioned against the wearer's face. The muzzle 120 may be formed of a harder, less resilient material that functions to protect the wearer from debris.

Each magnetic coupling assembly 28 includes a first portion 136 coupled to the muzzle 120 and a second portion 140 coupled to a respective one of the strap assemblies 32. The first and second portions 136, 140 are configured for releasable snapping and magnetic coupling with one another, and in this regard may include FIDLOCK coupling mechanisms, available from Fidlock GmbH of Hannover, Germany, that uses magnetic forces to guide the first and second portions 136, 140 into snapping engagement with one another. The second portion 140 of each coupling assembly 28 is coupled to a respective strap assembly 32. Each strap assembly 32 includes a first end 144 coupled to the second coupling portion 140 and a second end 148 having a plurality of saw-tooth grooves 152 formed thereon. The saw-tooth grooves 152 are configured for ratcheting engagement with a respective one of the ratchet assemblies 36 for adjusting the fit of the faceguard assembly 20. Once the relative positions of the strap assemblies 32 has been set using the ratchet assemblies 36, one or both sides of the faceguard assembly 20 can be quickly and easily removed and attached by way of the magnetic coupling assemblies 28.

Figure 13:
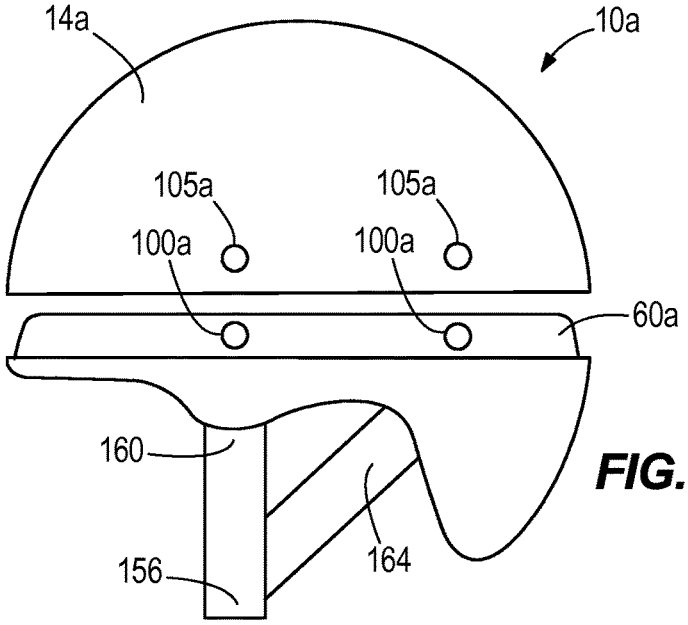
FIG. 13 is a schematic side view of an inventive motorsport helmet according to a second embodiment.

FIG. 13 is an alternative embodiment of a helmet 10*a* including a shell 14*a* and a support portion 60*a*. The structure of the helmet 10*a* of FIG. 13 is similar to the structure of the helmet 10 of FIG. 1; however, the helmet 10*a* includes a chin strap assembly 156 for securing the helmet 10*a* to the wearer's head. In the embodiment of FIG. 13, the chin strap assembly 156 may be secured to the helmet 10 using the same attachment features used to secure the shell 14*a* to the support portion 60*a*. More specifically, the chin strap assembly 156 includes a forward strap member 160 and a rearward strap member 164. The forward and rearward strap members 160, 164 may be secured to the helmet by fasteners (not shown) that extend through the holes 100*a*, 105*a* provided in the support portion 60*a* and the shell 14*a*, respectively, for coupling the shell 14*a* to the support portion 60*a*.

Figure 14:
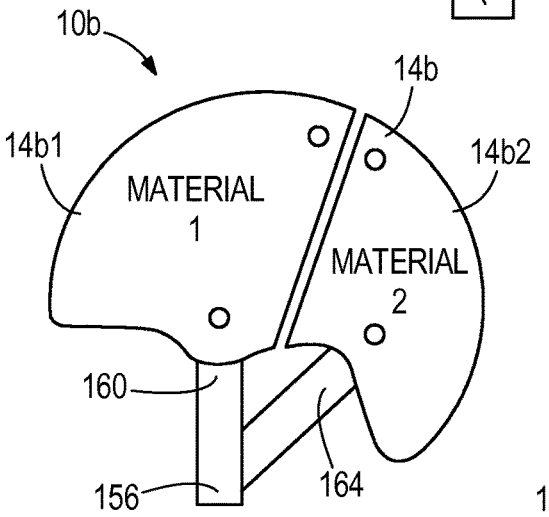
FIG. 14 is a schematic side view of an inventive motorsport helmet according to a third embodiment.

FIG. 14 illustrates another alternative embodiment of a helmet 10*b* that includes a multi-part shell 14*b*. The illustrated multi-part shell 14*b* includes a first part 14*b*1 that may comprise a forward portion of the helmet 10*b*. The first part 14*b*1 may have first characteristics, such as being formed of a first material, having a first thickness, and the like. The multi-part shell 14*b* also includes a second part 14*b*2 that may comprise a rearward portion of the helmet 10*b*. The second part 14*b*2 may have second characteristics different from the first characteristics, such as being formed of a second material and having a second thickness. The helmet 10*b* also includes a chin strap assembly 156 including a forward strap member 160 that is coupled to the first part 14*b*1 of the multi-part shell 14*b* and a rearward strap member 164 that is coupled to the second part 14*b*2 of the multi-part shell 14*b*. By forming the shell 14*b* in two or more parts, specific areas of the helmet 10*b* can be "tuned" to provide levels of protection appropriate for the specific area of the helmet. For example, areas requiring more protection can be specifically formed of thicker, stronger, and generally heavier materials, while areas requiring less protection can be formed of thinner, less strong, and generally lighter materials. As a result, the total weight of the helmet 10*b* may be reduced compared to a similarly styled and configured helmet having a single-piece shell. The multi-part shell construction may also expand the available styling and manufacturing options available to a helmet designer.

Figure 15:
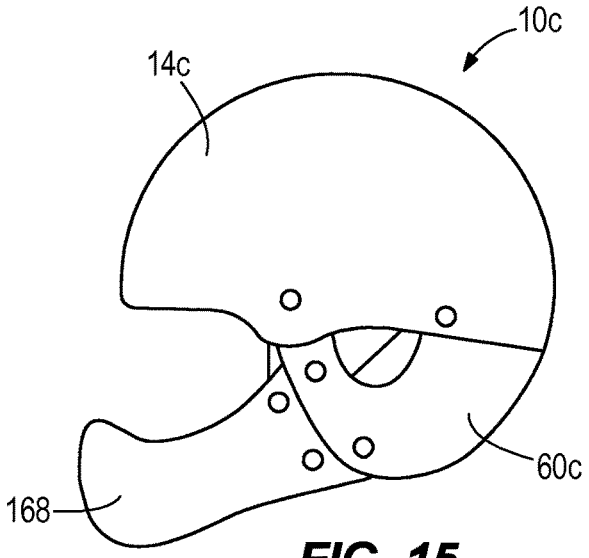
FIG. 15 is a schematic side view of an inventive motorsport helmet according to a fourth embodiment.

FIG. 15 illustrates another alternative embodiment of a helmet 10*c* that includes a rigid chin bar 168. The support portion 60*c* of the helmet 10*c* is configured to extend around the ear of the wearer to protect the wearer's cheek area. The chin bar 168 is coupled to a forward edge 170 of the support portion 60*c*. The chin bar 168, support portion 60*c*, and shell 14*c* of the helmet 10*c* may be coupled together using fasteners or any of the other attachment mechanisms discussed herein. In some embodiments, the chin bar 168 may be removably coupled to the support portion 60*c* such that the chin bar 168 can be selectively installed or removed by the user. The multi-part or modular construction of the helmet 10*c* can allow the user to choose different levels of protection and different aesthetic appearances for the helmet 10*c* depending upon, for example, the anticipated type of riding the wearer will be participating in.

Figure 16:
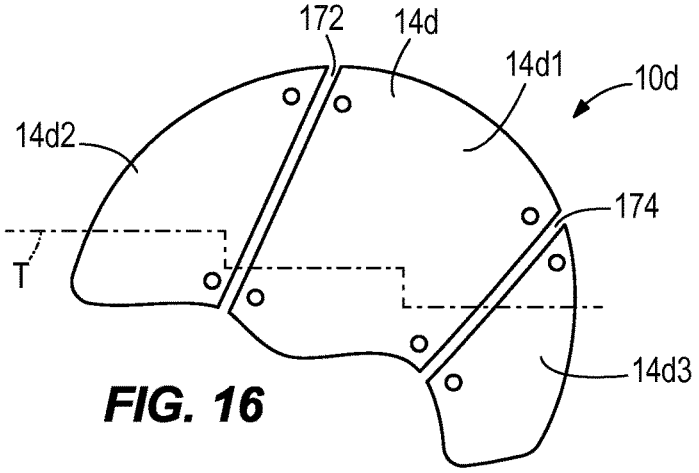
FIG. 16 is a schematic perspective view of an inventive motorsport helmet according to a fifth embodiment.
Figure 17:
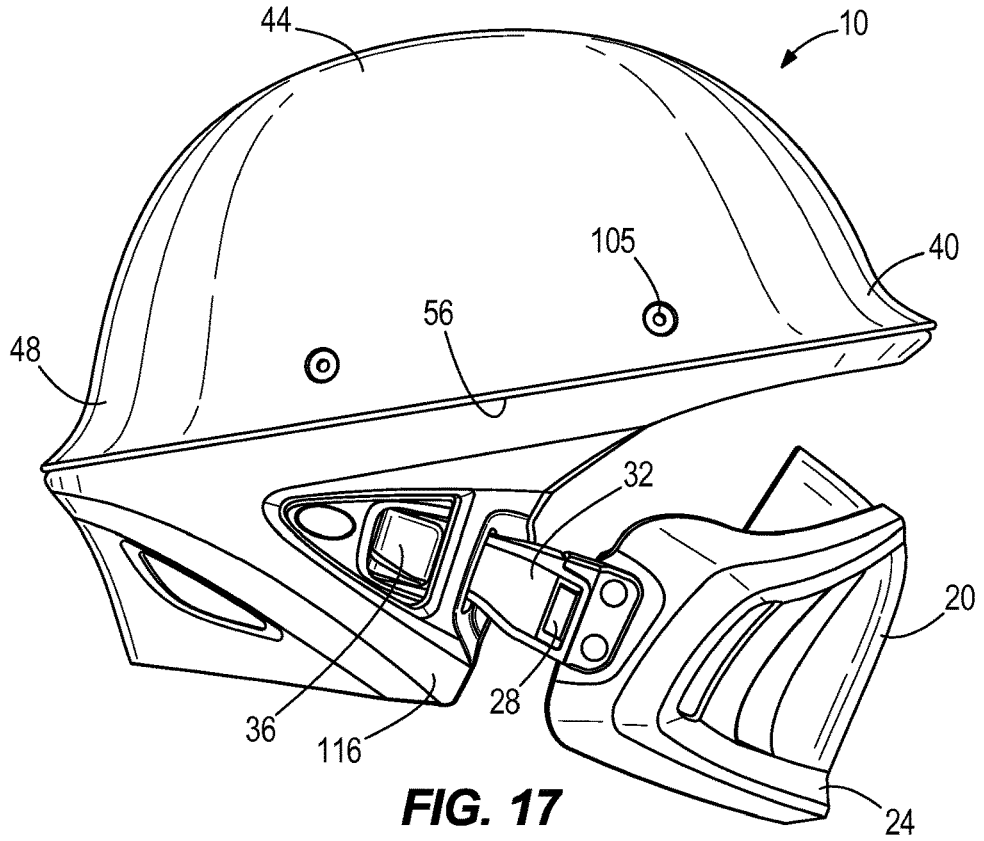
FIG. 17 is a right side view of the helmet of FIG. 1.
Figure 18:
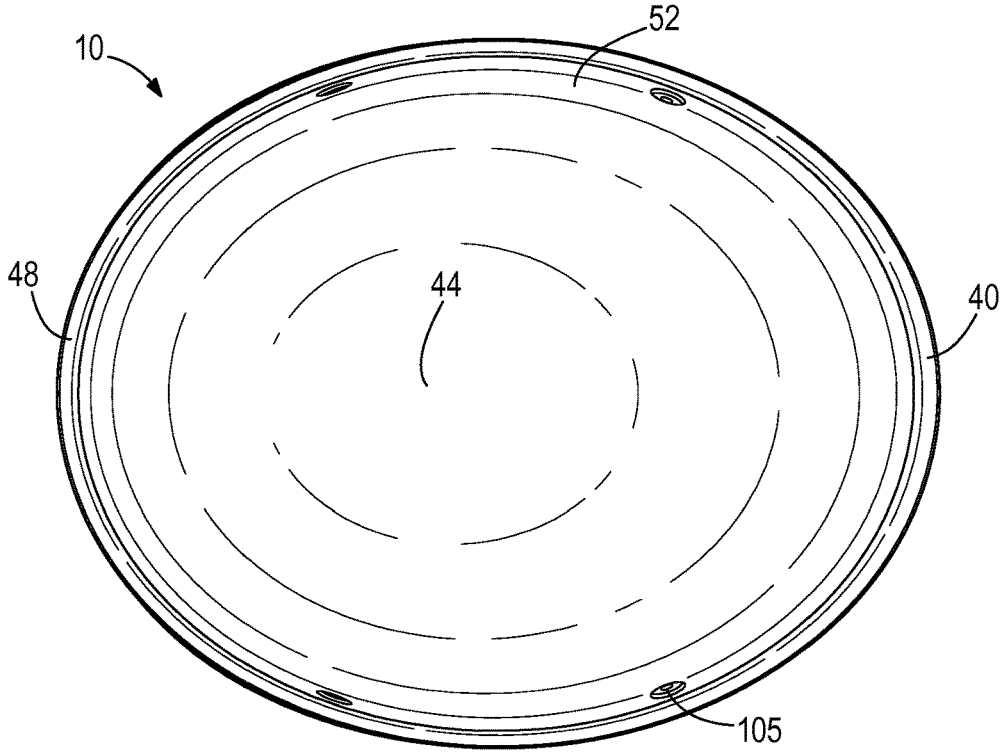
FIG. 18 is a top view of the helmet of FIG. 1.
Figure 19:
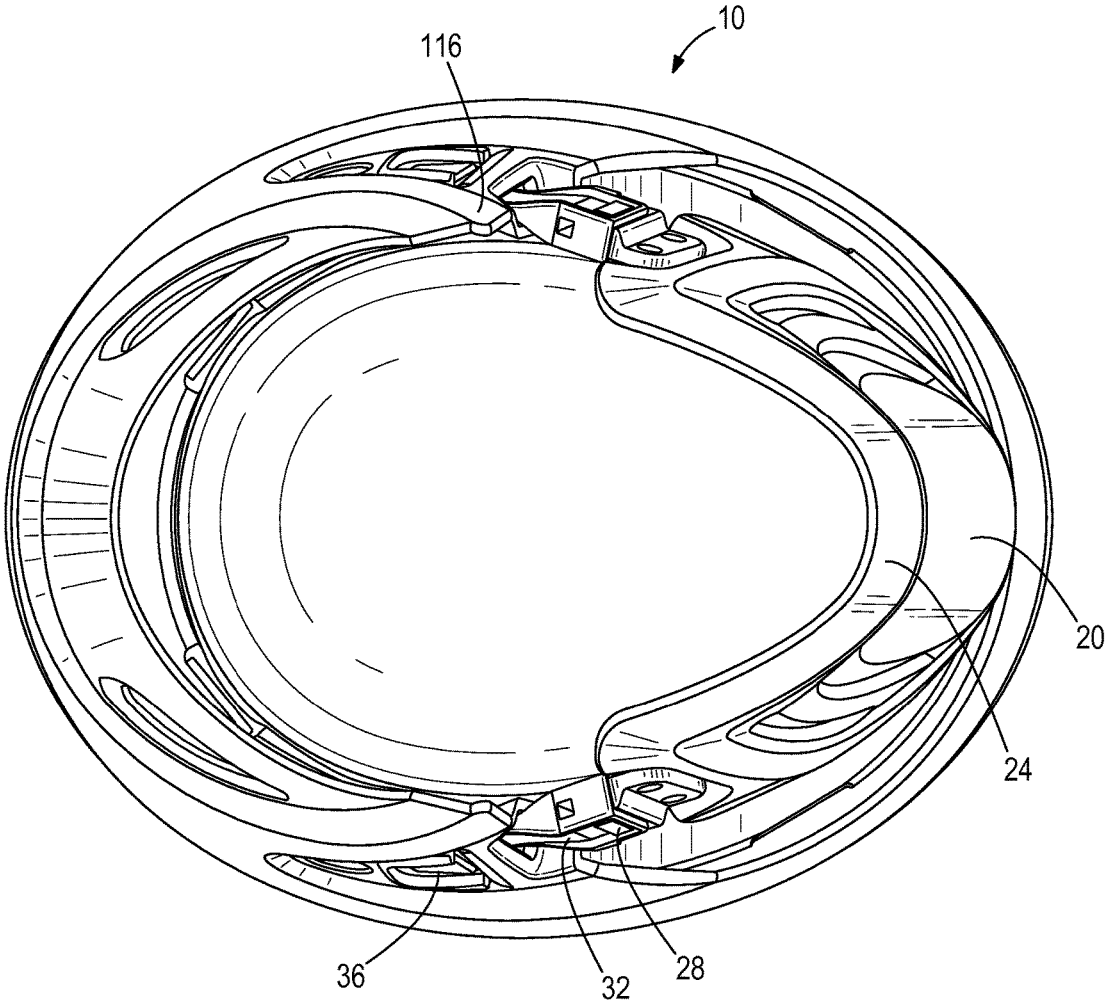
FIG. 19 is a bottom view of the helmet of FIG. 1.

FIG. 16 illustrates yet another alternative embodiment of a helmet 10*d* that includes a multi-part shell 14*d*. The multi-part shell 14*d* includes a central portion or helmet chassis 14*d*1, a front portion 14*d*2 coupled to the chassis 14*d*1 along a first interface 172, and a rear portion 14*d*3 coupled to the chassis 14*d*1 along a second interface 174. The chassis 14*d*1, front portion 14*d*2, and rear portion 14*d*3 may be coupled to one another by fasteners or any of the other attachment mechanisms discussed herein. One or more support portions similar to the support portion 60 discussed above may be provided along the first and second interfaces 172, 174 to lend structural support to the interfaces 172, 174. FIG. 16 also depicts the approximate location of the test line T with respect to the helmet 10*d*. As shown, each interface 172, 174 intersects the test line T at an angle between about 45 degrees and about 90 degrees. The construction of the embodiment of FIG. 16 provides a designer with an even greater variety of helmet design options. For example, a family of helmets can be designed around a common chassis 14*d*1, thereby minimizing cost. Using a common chassis 14*d*1, front portions 14*d*2 and rear portions 14*d*3 having different levels of protection and different aesthetic appearances can be mixed and matched with one another to provide a helmet having desired protective and/or aesthetic characteristics.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A motorsport helmet comprising:

an impact-resistant shell having a lower edge and shell through holes formed through the impact-resistant shell;

an impact-attenuating liner formed of impact attenuating material, that further comprises: an outer surface that is oriented towards, and extends along; an inner surface of the impact-resistant shell; and a liner rear extension that extends downwardly from the lower edge;

a support portion coupled to the impact-resistant shell with rivets disposed in the shell through holes, the support portion extending between the impact-resistant shell and the impact-attenuating adjacent the lower edge, the support portion further comprising:

an attachment lip sandwiched between, and overlapping with, the lower edge of the impact-resistant shell and the outer surface of the impact-attenuating liner that extends along the inner surface of the impact-resistant shell, the attachment lip further comprising attachment lip through holes formed through the attachment lip that correspond to, and align with, the shell through holes and the rivets when the impact-resistant shell is positioned over the attachment lip, and a rear extension extending downwardly from the lower edge and along the liner rear extension; and a lower extension sandwiched between, and overlapping with, the lower edge of the impact-resistant shell and the attachment lip, wherein the attachment lip extends along the inner surface of the impact-resistant shell, the lower extension covering the rear extension of the support portion and the liner rear extension, the lower extension extending below the rear extension of the support portion along an entire length of the lower extension.

2. The motorsport helmet of claim 1, wherein the lower edge defines a closed perimeter of the impact-resistant shell and resides substantially in a single plane.

3. The motorsport helmet of claim 1, wherein the impact-attenuating liner includes a forward portion having a bottom surface, and wherein the bottom surface is substantially co-planar with the lower edge of the impact-resistant shell.

4. The motorsport helmet of claim 1, wherein the support portion comprises a ring structure.

5. The motorsport helmet of claim 4, wherein the support portion includes a central band having a substantially triangular cross section, the central band extending around a circumference of the support portion.

6. The motorsport helmet of claim 1, wherein the support portion includes the attachment lip extending upwardly from the lower edge and into the impact-resistant shell between the impact-resistant shell and the impact-attenuating liner, and wherein the attachment lip couples the support portion to the impact-resistant shell.

7. The motorsport helmet of claim 1, further comprising a muzzle adapted to cover the mouth and chin area of a wearer, and a magnetic coupling assembly releasably coupling the muzzle to the support portion.

8. The motorsport helmet of claim 1, wherein the shell further comprises a first part adapted to cover a first portion of a wearer's head, and a second part adapted to cover a second portion of the wearer's head, wherein the first and second parts are separately formed and joined together.

9. The motorsport helmet of claim 8, further comprising a chinstrap having a forward strap member and a rearward strap member, wherein the forward strap member is coupled to the first part of the shell and wherein the rearward strap member is coupled to the second part of the shell.

10. The motorsport helmet of claim 1, wherein the support portion comprises a ring structure and further comprises the attachment lip extending upwardly from the lower edge and into the impact-resistant shell to couple the support portion to the shell.

* * * * *